US010190564B2

(12) United States Patent
Ruan et al.

(10) Patent No.: US 10,190,564 B2
(45) Date of Patent: Jan. 29, 2019

(54) METHOD FOR ACTUATING A SPARK GAP

(71) Applicant: BorgWarner BERU Systems GmbH, Ludwigsburg (DE)

(72) Inventors: Ganghua Ruan, Ludwigsburg (DE); Dejan Kienzle, Heilbronn (DE)

(73) Assignee: BORGWARNER BERU SYSTEMS GMBH, Ludwigsburg (DE)

( * ) Notice: Subject to any disclaimer, the term of this patent is extended or adjusted under 35 U.S.C. 154(b) by 117 days.

(21) Appl. No.: 15/355,639

(22) Filed: Nov. 18, 2016

(65) Prior Publication Data

US 2017/0067434 A1 Mar. 9, 2017

Related U.S. Application Data

(62) Division of application No. 13/796,627, filed on Mar. 12, 2013, now Pat. No. 9,531,165.

(30) Foreign Application Priority Data

Mar. 14, 2012 (DE) ..... 10 2012 102 168
Jul. 10, 2012 (DE) ..... 10 2012 106 207

(51) Int. Cl.
*F02P 3/045* (2006.01)
*F02P 3/04* (2006.01)
(Continued)

(52) U.S. Cl.
CPC ..... *F02P 3/045* (2013.01); *F02B 75/18* (2013.01); *F02P 3/04* (2013.01); *F02P 3/0407* (2013.01);
(Continued)

(58) Field of Classification Search
CPC ..... F02P 3/0407; F02P 3/0414; F02P 3/0435; F02P 3/0442; F02P 3/053; F02P 3/045; F02P 15/10
See application file for complete search history.

(56) References Cited

U.S. PATENT DOCUMENTS 4,462,380 A 7/1984 Asik
4,493,306 A 1/1985 Asik
(Continued)

FOREIGN PATENT DOCUMENTS

DE 600 12 073 T2 9/2005
EP 2 325 476 A1 5/2011
(Continued)

*Primary Examiner* — Sizo Vilakazi
*Assistant Examiner* — Kevin R Steckbauer
(74) *Attorney, Agent, or Firm* — Bose McKinney & Evans LLP

(57) ABSTRACT

A method for actuating a spark plug, in which the spark plug is assigned a first ignition coil and second ignition coil. Triggered by a start signal, the primary winding of the first ignition coil is charged, and the primary winding of the second ignition coil is charged with a delay D, for which 0≤D, by supplying a direct current, wherein, while each primary winding, is charged, the respective secondary winding is blocked; the primary current supplied to the primary windings is measured; after a period T, the primary winding of the first ignition coil is discharged, and with the delay D the primary winding of the second ignition coil is discharged; the secondary current flowing through the spark plug is measured; thereafter the primary windings of the first and second ignition coil start to be charged alternately when the secondary current falls below a threshold; the primary windings are discharged alternately when the primary current reaches an upper threshold; the above steps are repeated until the duration of discharge between two electrodes of the spark plug 1 reaches a predefined value Z.

18 Claims, 9 Drawing Sheets

(51) Int. Cl.

| | |
|---|---|
| ***F02P 15/10*** | (2006.01) |
| ***H01T 13/44*** | (2006.01) |
| ***H01T 15/00*** | (2006.01) |
| ***F02P 3/05*** | (2006.01) |
| ***F02P 17/12*** | (2006.01) |
| ***F02B 75/18*** | (2006.01) |
| *F02P 3/055* | (2006.01) |

(52) U.S. Cl.

CPC ..... *F02P 3/0414* (2013.01); *F02P 3/0435* (2013.01); *F02P 3/0442* (2013.01); *F02P 3/05* (2013.01); *F02P 3/053* (2013.01); *F02P 15/10* (2013.01); *F02P 17/12* (2013.01); *H01T 13/44* (2013.01); *H01T 15/00* (2013.01); *F02B 2075/1808* (2013.01); *F02P 3/055* (2013.01)

(56) References Cited

U.S. PATENT DOCUMENTS

| | | | | |
|---|---|---|---|---|
| 5,097,815 | A * | 3/1992 | Oota | F02P 15/008 123/606 |
| 5,140,970 | A | 8/1992 | Akaki et al. | |
| 5,193,515 | A | 3/1993 | Oota et al. | |
| 5,197,449 | A | 3/1993 | Okamoto et al. | |
| 5,404,860 | A | 4/1995 | Morino | |
| 8,813,732 | B2 * | 8/2014 | Kataoka | F02P 3/051 123/621 |
| 9,531,165 | B2 * | 12/2016 | Ruan | F02P 3/053 |
| 9,812,955 | B2 * | 11/2017 | Wustenhagen | H02M 1/36 |
| 2003/0089355 | A1 | 5/2003 | Vogel et al. | |
| 2005/0279337 | A1 | 12/2005 | Biljenga | |
| 2007/0181110 | A1 | 8/2007 | Toriyama et al. | |
| 2009/0194083 | A1 | 8/2009 | Boerjes | |
| 2012/0017881 | A1 * | 1/2012 | Kataoka | F02P 3/051 123/621 |
| 2012/0055455 | A1 * | 3/2012 | Ruan | F02P 23/04 123/608 |
| 2012/0160222 | A1 | 6/2012 | Grady | |
| 2012/0186569 | A1 | 7/2012 | Shimakawa et al. | |
| 2013/0241429 | A1 * | 9/2013 | Ruan | F02P 3/053 315/220 |
| 2014/0360476 | A1 | 12/2014 | Huberts et al. | |
| 2017/0067434 | A1 * | 3/2017 | Ruan | F02P 3/053 |
| 2017/0077804 | A1 * | 3/2017 | Wustenhagen | H02M 1/36 |
| 2017/0350364 | A1 * | 12/2017 | Wustenhagen | F02P 3/04 |

FOREIGN PATENT DOCUMENTS

| | | |
|---|---|---|
| EP | 2 410 169 A1 | 1/2012 |
| EP | 2 479 420 A2 | 7/2012 |

* cited by examiner

METHOD FOR ACTUATING A SPARK GAP

RELATED APPLICATIONS

This application is a divisional of U.S. application Ser. No. 13/796,627 filed Mar. 12, 2013 which claims priority to DE 10 2012 102 168.6, filed Mar. 14, 2012 and DE 10 2012 106 207.2, filed Jul. 10, 2012, all of which are hereby incorporated by reference in their entirety.

BACKGROUND

The invention relates to a method for actuating a spark gap in an internal combustion engine, in particular a spark plug, in which the spark gap is assigned a first ignition coil and a second ignition coil, each of which has a primary winding and a secondary winding that are inductively coupled to one another.

EP 2 325 476 A1 discloses a control unit for a spark plug in an internal combustion engine, said unit making it possible to increase the duration of the ignition spark. For this purpose, two ignition coils are assigned to the spark plug and are operated in a manner offset over time (controlled by a control device). The method starts in that a start signal for the ignition of the spark plug comes from an engine control unit, whereupon both primary coils are connected to the vehicle battery or to the dynamo of the vehicle and are charged. This occurs as long as the start signal coming from the engine control unit is present. When it disappears, the two primary windings are discharged by opening semiconductor switches that are arranged in the electrical circuit of the primary windings. As a result, a high voltage is induced in each of the secondary windings, which leads to a discharge between two electrodes of the spark plug. The two semiconductor switches are subsequently opened and closed alternately so that one of the two ignition coils always stores magnetic energy whilst the other delivers the stored energy to the spark plug. If the primary current exceeds a predefined limit value, it is restricted by opening a bypass so that the ignition coils do not reach magnetic saturation. The bypass continues to be opened and closed so as to thus keep constant the energy stored in the ignition coils. The semiconductor switches are switched over whenever the amperage of the secondary current falls below a predefined minimum. This minimum is determined newly in each cycle as a function of the maximum encountered primary current. A diode that blocks the secondary current whilst the primary winding is charged and allows the secondary current to pass whilst the primary winding is discharged is located in the electrical circuit of each secondary winding. To protect the diode against overload, the gradient over time of the secondary current, which is a measure for the magnitude of the secondary voltage, is monitored and is interrupted if a specific voltage level of the ignition process is exceeded. A disadvantage of this prior art is that, in spite of a considerable control effort, it is difficult to create stable conditions at the spark plug for a discharge process lasting for a predefined period of time.

SUMMARY

The present invention creates, at low cost in an ignition system of the type mentioned in the introduction, stable conditions at the spark gap, in particular at a spark plug, for generating a discharge process lasting for a predefined period.

The method according to this disclosure for actuating a spark gap in an internal combustion engine, in which the spark gap is assigned a first ignition coil and a second ignition coil, each of which has a primary winding and a secondary winding that are inductively coupled to one another, may include the following steps:

(a) triggered by a start signal, the primary winding of the first ignition coil is charged, and with a delay D, for which $0 \leq D$, the primary winding of the second ignition coil is charged by supplying direct current, wherein, whilst each primary winding is charged, the respective secondary winding is blocked. The start signal is given according to the desired ignition point (ignition timing).

(b) The total primary current flowing in the primary windings is preferably measured constantly.

(c) After a period T after the start signal, the end of said period marking the ignition time-point, the primary winding of the first ignition coil is abruptly discharged, and the primary winding of the second ignition coil is abruptly discharged with the delay D. Secondary currents are thus induced in the respective secondary windings and lead to an electrical discharge between two electrodes of the spark gap.

(d) The total secondary current flowing through the spark gap is preferably measured constantly.

(e) Thereafter the charging of the primary winding of the first ignition coil and of the primary winding of the second ignition coil are alternately started whenever the total secondary current falls below an upper threshold.

(f) The primary windings are then abruptly discharged whenever the total secondary current reaches a lower threshold or whenever the total primary current reaches an upper threshold.

(g) Steps (e) and (f) are repeated until the duration of the discharge process between two electrodes of the spark gap reaches a predefined value Z.

(h) Both primary windings then remain separated from the supply of direct current until there occurs a further start signal and the above sequence of steps is restarted with step (a).

In particular, a spark plug is a possible spark gap. However, instead of a spark plug, other ignition devices may also be used, with which ignition sparks can be generated in an internal combustion engine, for example an electrode, which is inserted through the cylinder head of an engine in an electrically insulated manner and which cooperates with a cylinder wall as a ground electrode so as to form a spark gap. This disclosure will be described hereinafter on the basis of spark plugs. The description is applicable to other spark gaps accordingly.

The start signal, which triggers the sequence of steps according to this disclosure, determines the ignition point for the spark plug and can be emitted for example by an engine control device or by a sensor, which is responsive to the position of a camshaft of the internal combustion engine. Triggered by the start signal, the primary winding of the first ignition coil is charged by supplying direct current. So that no secondary current flows in the respective secondary winding during this process, the secondary winding is blocked, preferably by a diode arranged in the electrical circuit of the secondary winding, whilst the respective primary winding is charged. Instead of a diode, a semiconductor switch located in the electrical circuit of the secondary winding could also be used to block said secondary winding and is controlled by the primary current, such that the semiconductor switch performs a blocking function as long as the primary current flows.

At the start of the method according to this disclosure, the primary winding of the second ignition coil is charged with a delay D compared to the primary winding of the first ignition coil, for which $0 \leq D$. The greater the overlap between the first charging process of the first ignition coil and the first charging process of the second ignition coil, the stronger the total primary current, which is given by adding the currents flowing through the two primary windings. The delay is preferably $D \neq 0$, that is to say the two first charging processes do not overlap completely, but only in part. The delay should not be selected to be so great, however, that the two first charging processes taking place at the start of the method according to this disclosure do no longer overlap at all, rather the overlap should lead to an increase in the strength of the first pulse of the total primary current.

In accordance with this disclosure, the total primary current supplied to the primary windings is measured. This measurement is expediently taken in the line coming from the direct current source at a point before this line branches to the two primary windings. If the internal combustion engine drives a vehicle, as is preferred, a vehicle battery or a direct current generator, for example the dynamo of the vehicle, are possible direct current sources. The amperage is measured for example such that a resistor is arranged in the line coming from the direct current source and the voltage drop caused by the direct current is measured at said resistor.

The primary windings are charged in that the current from the positive pole of a direct current source flows through the device for measuring the strength of the primary current, through the first primary winding to the ground pole of the direct current source and also through the second primary winding to the ground pole of the direct current source. The direction of current "from the positive pole of the direct current source to the ground pole" is to be understood in the sense of standard technical language; the electrons flow in the opposite direction. The charging processes of the primary winding of the first ignition coil and of the primary winding of the second ignition coil are to be interrupted before the ignition coil reaches saturation. A considerable distance should be maintained from the state of saturation. It is thus recommended to interrupt the charging processes at the latest when 95% of the saturation amperage has been reached in the primary windings. In a particularly advantageous embodiment of the method, the charging processes are interrupted whilst the amperage in the primary windings still rises approximately linearly. By charging of the primary windings, however, an amount of energy that is sufficient to generate a spark as a result of the subsequent discharge of the ignition coil between two electrodes of the spark plug and sufficient to maintain the discharge thus ignited must be stored in any case for a certain period.

A semiconductor switch is preferably provided in the line from each of the primary windings to the ground pole and is controlled by a control device. The respective semiconductor switch is closed whilst a primary winding is charged. The primary current flowing through the primary winding, the increase of said current being slowed by self-induction, leads to a growth of the energy that is stored in the magnetic circuit of the ignition coil and that energy is released when the primary current is interrupted by opening the semiconductor switch, thus terminating the charging process. Due to the abrupt change of current in the primary winding, a high secondary voltage is induced in the respective secondary winding and results in a secondary current, causing the desired electrical discharge between two electrodes of the spark plug, specifically between a central electrode and a ground electrode arranged at a distance therefrom.

If T is the duration of the first charging process of the primary windings, the offset D over time between these two charging processes should be $0 \leq D < T$. D is preferably approximately half as long as T.

The two ignition coils are discharged in a manner offset over time by the control unit according to this disclosure dependent on the amperages. As a result, the secondary currents in the two secondary windings accordingly occur offset over time. The offset over time is to be selected such that the two secondary currents occurring in different secondary windings do not only overlap in the event of the first discharge of the two primary windings occurring after a start signal, but also with the following discharge processes, so that there are no gaps in the total secondary current supplied to the spark gap or spark plug, respectively. The "total secondary current" is understood to mean the sum of secondary currents, which flow into the two individual secondary windings, formed by superimposing the secondary currents. The total secondary current should not fall below a lower threshold, which is to be selected so as to be so high that the discharge burning between the electrodes of the spark plug does not extinguish if the total secondary current reaches this lower threshold. A switchover, on the primary side of the ignition coil of which the primary winding has just been charged, from charging to discharging is therefore implemented at the latest once this lower threshold of the total secondary current has been reached, and the total secondary current is thus abruptly increased again.

So that the total secondary current can be monitored, it has to be measured. It is expediently measured by providing an ammeter, in particular a resistor, in a line that connects both the secondary winding of the first ignition coil and the secondary winding of the second ignition coil to a ground pole, the drop in voltage being measured at said ammeter as a measure for the amperage of the total secondary current. The measured total primary current and the measured total secondary current are expediently conveyed to a control device, which controls, for both ignition coils, the moment for switching from charging to discharging of the primary winding and the moment for switching from discharging to charging of the primary winding.

After, as a result of the first charging and discharging of the primary winding of the first ignition coil and as a result of the first charging and discharging of the primary winding of the second ignition coil, a discharge has been started between the electrodes of the spark plug, the primary winding of the first ignition coil and the primary winding of the second ignition coil then start to be charged alternately whenever the total secondary current falls below an upper threshold. It can thus be ensured that there is sufficient time available during the current discharge of either of the two primary windings to charge the other primary winding to such an extent that the discharge burning between the electrodes of the spark plug will continue without interruption. The charging of the primary windings ends each time the primary current reaches an upper threshold, which is selected such that sufficient magnetic energy has been stored up to that point in the relevant ignition coil so as to continue without interruption the discharge burning between the electrodes of the spark plug when the ignition coil is discharged. At the latest, the charging of the primary windings thus ends each time the total secondary current coming from above reaches a lower threshold, which is selected such that the amperage of the total secondary current is still sufficient to maintain the discharge burning between the electrodes of the spark plug. The primary winding that has just been charged is switched from charging to discharging at the latest when this lower threshold of the total secondary current is reached, whereby the total secondary current increases abruptly again until above its upper predefined threshold.

The described interaction between the two ignition coils is continued until a preselected duration, during which the discharge is to burn between the electrodes of the spark plug, has elapsed. This duration is referred to in this instance as the ignition period. The two ignition coils are then separated from the direct current supply so that the discharge burning between the electrodes of the spark plug extinguishes. The method according to this disclosure is run through again with the occurrence of the next start signal, which may come from an engine control unit. The method according to this disclosure is run through in full for each spark plug in each operating cycle of the internal combustion engine. The operating cycle consists in a four-stroke engine of four successive strokes, and in a two-stroke engine of two successive strokes.

The threshold values for the primary current and for the secondary current may remain the same or may be changed for each run of the method according to this disclosure. The lower threshold of the secondary current may remain the same for each run of the method according to this disclosure, this being the preferred scenario.

In an advantageous development of the method the upper threshold for the primary current may vary. It may be predefined in a variable manner by an engine control unit according to the operating mode of the internal combustion engine. The fuel consumption of the engine and the pollutant emission of the engine can thus be optimised, for example depending on the engine load and/or on the engine speed and/or on the cooling water temperature and/or on the composition of the exhaust gas, for which the starting signal of a lambda sensor in the exhaust gas system is a useful parameter.

The upper threshold of the total primary current may be changed incrementally or continuously within a run of the method according to this disclosure, provided a discharge burns between the electrodes of the spark plug; if the upper threshold of the total primary current is to be changed, the threshold is preferably changed between two successive runs of the method according to this disclosure.

The upper threshold of the total secondary current can be changed to optimise the fuel consumption and the pollutant emission of the engine in accordance with the manner in which the upper threshold of the primary current is changed.

This disclosure provides considerable advantages:

To control the ignition process, it is sufficient to determine merely threshold values for the total primary current and for the total secondary current and to determine the points in time for the charging and discharging of the primary windings merely by reaching two threshold values, specifically by reaching an upper threshold of the total primary current and by reaching from above an upper threshold of the total secondary current. The lower threshold of the total secondary current is merely to be reached as an advantageous option for ensuring that there are no gaps in the discharge burning between the electrodes of the spark plug within the desired ignition period.

The ignition process is controlled just as easily with the method according to this disclosure as with a two-point control.

It is not necessary to monitor the secondary voltage.

There is no need to predefine any time intervals.

Apart from the initial onset of charging of the two ignition coils, said ignition coils are controlled during the desired ignition period on the basis of current monitoring. A continuous and stable spark is thus achieved irrespective of any voltage fluctuations and of unequal voltage increase and voltage drop rates during the desired ignition period. A self-regulating effect is achieved by use of this disclosure.

Conditions that are more stable for a discharge burning between the electrodes of the spark plug are achieved in spite of a lower amount of control installation compared to the prior art and can be maintained for a predefineable period.

By changing the upper threshold values for the total primary current and/or for the total secondary current, the function of the internal combustion engine can be optimised depending on the engine state, in particular in terms of fuel consumption, pollutant emission and power output.

Not only can the maximum ignition current flowing via the spark plug be set by the selection of the threshold values, but also the effective, averaged ignition current. This makes it possible to optimise the service life of the spark plug.

The energy released by the discharge occurring between the electrodes of the spark plug can be set by the selection of the threshold values. This contributes to the optimisation of the ignition of the air/fuel mixture, fuel consumption and pollutant emissions.

The ignition period can be set largely arbitrarily.

Another exemplary method differs from the method described above in that, instead of the total primary current and the total secondary current, components thereof, namely the currents flowing into the two individual primary windings and the currents flowing into the two individual secondary windings, are monitored in terms of the moment at which threshold values are reached and are used to help to control the ignition processes. Practically the same ignition current profile and practically the same advantages as in the case of the method described above are achieved.

It also possible to combine the two methods just mentioned by monitoring either the total primary current and the individual secondary currents or the individual primary currents and the total secondary current.

These teachings can be applied to a situation in which more than two ignition coils per spark plug are operated in a coordinated manner and provide their contribution to an ignition current in a cyclically swapped manner, said ignition current flowing without interruption during the desired ignition period.

In an advantageous development of this disclosure, two ignition coils control not only one, but two spark plugs and ignite them simultaneously or approximately simultaneously. The two spark plugs are selected such that they belong to a pair of two cylinders of a spark ignition engine having an even number of cylinders. The cylinders of the spark ignition engine are assigned in pairs to a pair of ignition coils, such that, of the two cylinders forming a pair, one cylinder is always located in the exhaust stroke when the other cylinder of the pair is located in its compression stroke. The two spark plugs are arranged in parallel. If one spark plug ignites in the compression stroke, the other spark plug then ignites in the exhaust stroke, and the situation is reversed in the next engine cycle.

This development is particularly suitable for four-stroke engines. It has the advantage that it is implemented with half the number of ignition coils.

In some embodiments, the charging of the primary winding of the first ignition coil and the charging of the primary winding of the second ignition coil are not started when the strength of the total secondary current falls below an upper threshold, but instead are started when a given time interval t1 or t2, respectively, ends, which begins whenever the strength of the total secondary current falls to a lower threshold or when the strength of the total primary current raises to an upper threshold.

In other embodiments, the charging of the primary winding of the first ignition coil and the charging of the primary winding of the second ignition coil are not started when the strength of the secondary current flowing through the first or second ignition coil, respectively, falls below a threshold. Instead the charging of the primary winding of the first ignition coil is started whenever a given time interval t1 ends, which begins whenever the strength of the secondary current flowing through the first ignition coil falls to a lower threshold or whenever the primary current flowing through the second ignition coil raises to an upper threshold. Likewise, the charging of the primary winding of the second ignition coil is started whenever a given time interval t2 ends which begins whenever the strength of the secondary current flowing through the second ignition coil falls to a lower threshold or whenever the primary current flowing through the first ignition coil raises to an upper threshold.

The time intervals t1 and t2 can be selected to be zero. If they are not selected to be zero, then they are anyway selected so short that the pulse-shaped secondary currents, which flow through the second ignition coil, follow without interruption in time the pulse-shaped secondary currents which flow through the first ignition coil. The pulse-shaped secondary currents can alternately overlap each other in time, instead of follow each other without interruption.

Preferably the time intervals t1 and t2 are so selected, that $0 \leq t1 \leq 500$ μs and $0 \leq t2 \leq 500$ μs. More preferably the time intervals t1 and t2 are so selected, that $0 \leq t1 \leq 100$ μs and $0 \leq t2 \leq 100$ μs.

The time intervals t1 and t2 can be changed, particularly corresponding to settings of an engine control unit. Preferably t1 and t2 are not changed during a run of the method from step (a) to step (b). Preferably t1 equals t2

The methods may be further combined by replacing (i) the feature that charging the primary winding of the first ignition coil and charging of the primary winding of the second ignition coil are alternately started whenever a given time interval t1 or t2 respectively ends with (ii) the feature that charging the primary winding of the first ignition coil is started whenever a given time interval t1 ends, which is started whenever the strength of the secondary current flowing through the first ignition coil falls below a threshold or whenever the primary current flowing through the second ignition coil rises to an upper threshold. Other combinations of the methods described above are also possible and examples are provided below.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
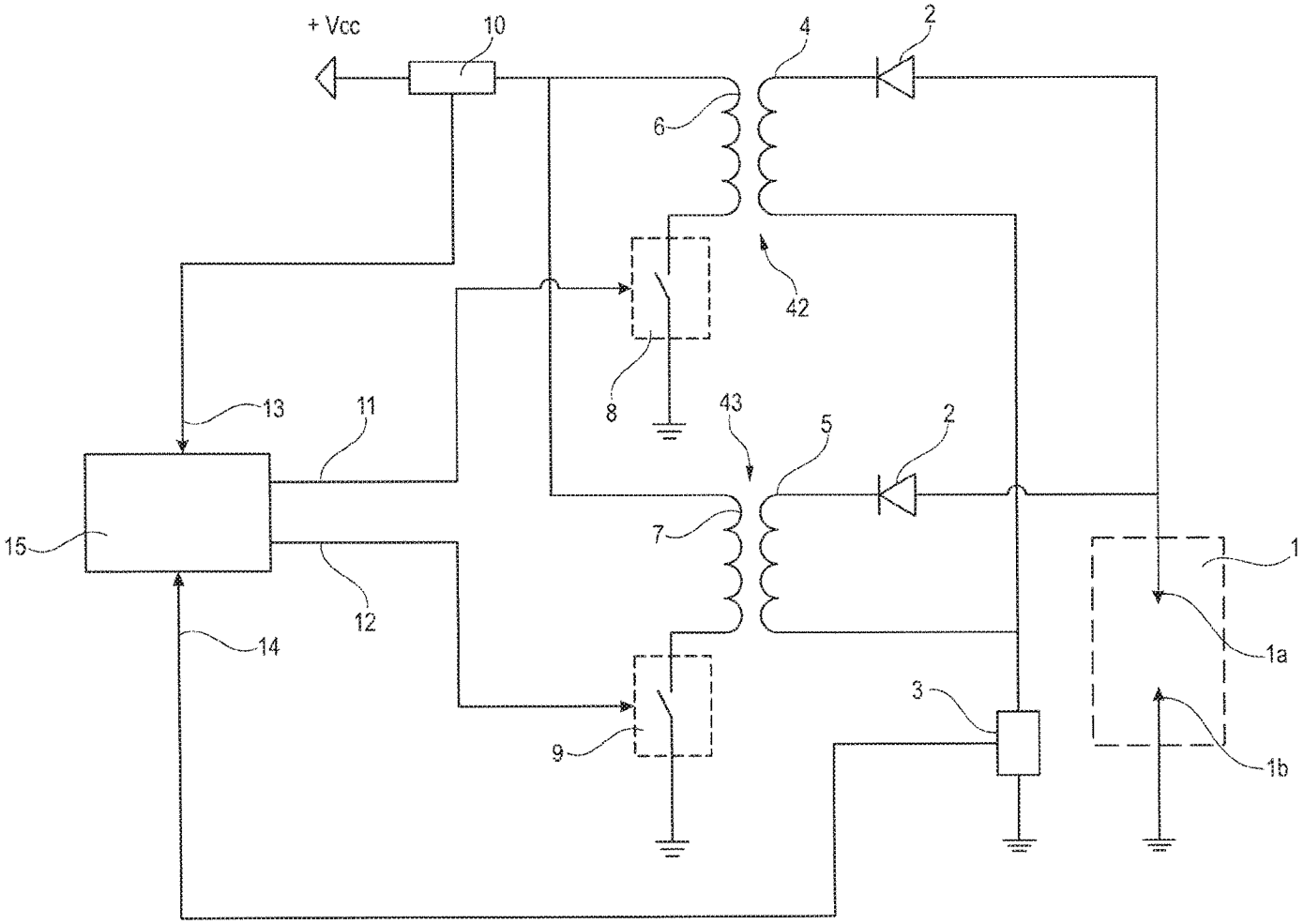
FIG. 1 shows a first circuit arrangement for carrying out the method according to this disclosure.

The circuit arrangement illustrated in FIG. 1 has a spark gap 1, for example a spark plug, with a central electrode 1*a* and a ground electrode 1*b*. Two ignition coils 42 and 43 are provided to supply the spark plug 1 with the necessary high voltage. The ignition coil 42 has a primary winding 6 and a secondary winding 4 coupled inductively thereto. The ignition coil 43 has a primary winding 7 and a secondary winding 5 coupled inductively thereto. A magnet core that couples the primary winding 6 and the secondary winding 4, as well as a magnet core that couples the primary winding 7 and the secondary winding 5 are not illustrated for reasons of simplicity. The secondary winding 4 lies together with the spark plug 1 in a first secondary electrical circuit. The secondary winding 5 is arranged together with the spark plug 1 in a second secondary electrical circuit. The two secondary electrical circuits are connected in parallel and both contain a diode 2, which blocks the flow of current in a direction from the central electrode 1*a*, via the secondary winding 4 or 5, to a ground pole. To measure the amperage of the total secondary current, which flows collectively in the two secondary electrical circuits, a measuring device 3 is provided, which is connected via a line 14 to a control device 15. As a main component, the control device may contain a microcontroller, a CPLD (complex programmable logic device), an FPGA (field programmable gate array) or an application-specific integrated circuit (ASIC). A measuring signal, which is a measure for the strength of the total secondary current measured, is supplied to the control device 15 via the line 14.

The two primary windings 6 and 7 are connected in parallel to a direct current source Vcc. A device 10 for measuring the strength of the total primary current, that is to say the strength of the current that flows collectively through the two primary windings 6 and 7, is located in the supply line, which connects the direct current source Vcc to both primary windings 6 and 7. The measuring device 10 is connected via a line 13 to the control device 15. A measuring signal is conveyed to the control device 15 via the line 13 and is a measure for the strength of the total primary current.

A controllable switch, in particular a semiconductor switch 8 and a semiconductor switch 9, is arranged in each of the two primary electrical circuits connected in parallel. The semiconductor switch 8 is connected to the control device 15 by a control line 11. The semiconductor switch 9 is connected to the control device 15 by a control line 12.

At the start of the method, the primary windings 6 and 7 are charged with direct current from the direct current source Vcc with closed semiconductor switches 8 and 9. The diodes 2 are connected such that the secondary windings 4 and 5 are blocked during charging of the primary windings 6 and 7. If the semiconductor switch 8 is opened, a very high voltage is produced in the secondary winding 4 due to an abrupt change of current in the primary winding 6 and results in a secondary direct current that flows in the forward direction of the diode 2 in the secondary electrical circuit. As soon as the high voltage exceeds the dielectric strength of the air/fuel mixture between the spark plug electrodes 1*a* and 1*b*, a discharge takes place therebetween. The two ignition coils 42 and 43 are controlled such that they operate in push-pull mode, so that a spark does not just flash over temporarily between the electrodes 1*a* and 1*b*. Before the discharge between the electrodes 1*a* and 1*b* caused by opening the semiconductor switch 8 extinguishes, the semiconductor switch 9 is opened and the semiconductor switch 8 is closed, such that the spark plug is supplied with further energy from the ignition coil 43, whilst a further charging process takes place at the same time in the ignition coil 42. This interaction is continued until the discharge between the electrodes 1*a* ends with opening of both semiconductor switches 8 and 9.

The method performed in this instance will be described in more detail on the basis of FIGS. 2 and 3:

The method according to this disclosure is initiated by a start signal 24. The start signal 24 may be a rectangular pulse lasting for a period T, of which the rising flank prompts the control device 15 to close the semiconductor switch 8. See the first graph in FIG. 2. As a result, a current 26 of increasing amperage flows through the primary winding 6, as is illustrated in the second graph in FIG. 2. The current 26 through the primary winding 6 increases approximately linearly and is interrupted as the period of time T expires by opening the semiconductor switch 8, before the primary winding 6 reaches saturation.

Figure 2:
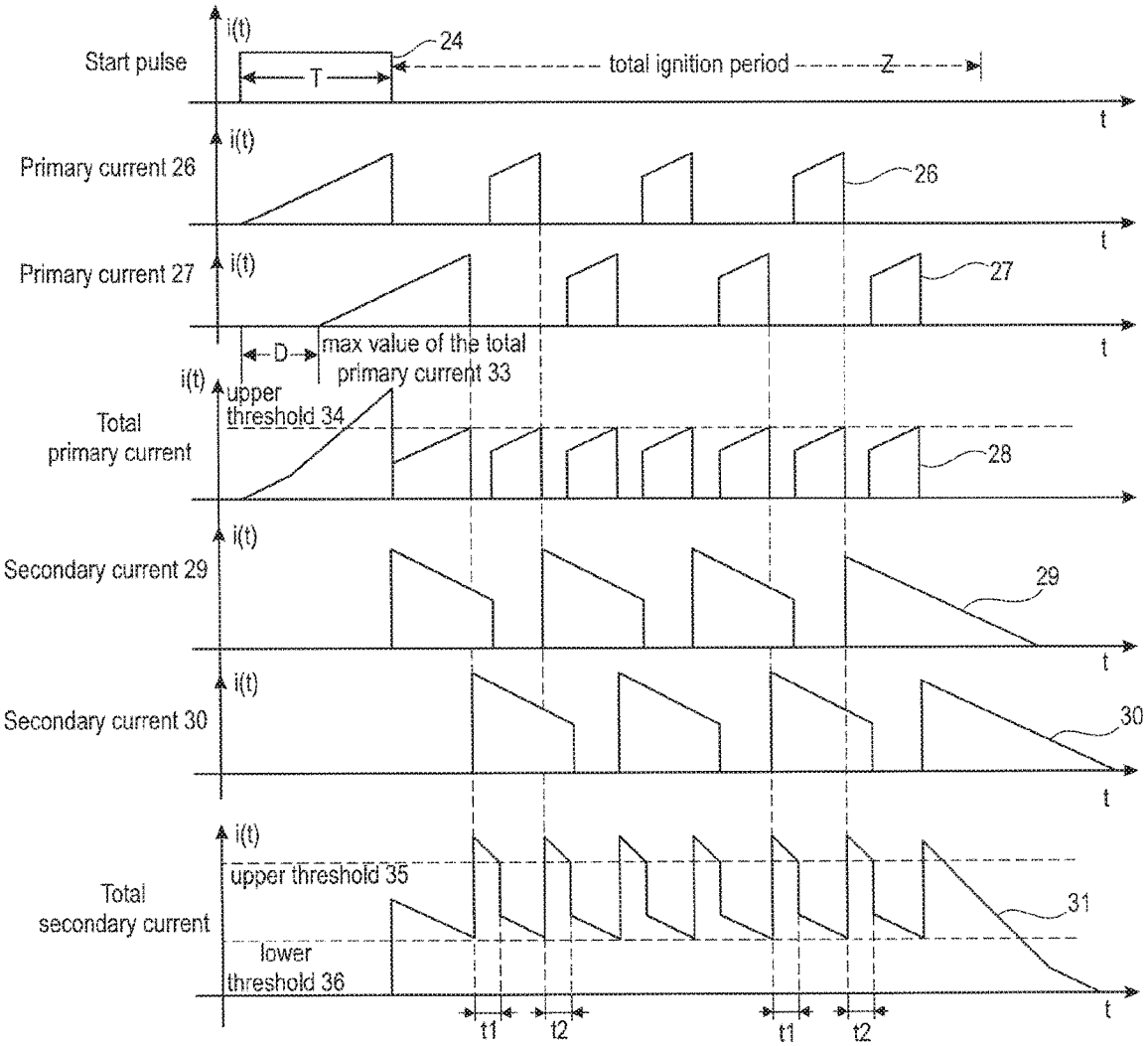
FIG. 2 shows a set of graphs, in which current profiles occurring in the circuit arrangement according to FIG. 1 are illustrated according to time.

With a time delay D after closing the semiconductor switch 8, which preferably corresponds approximately to half the period T, the semiconductor switch 9 is closed, so that a current 27 of increasing amperage starts to flow in the primary winding 7, as illustrated in the third graph in FIG. 2.

The primary currents 26 and 27 flowing through the two primary windings 6 and 7 add each other by superimposition in the supply line, in which the ammeter 10 is arranged, to give a total primary current 28, the profile of which is illustrated in the fourth graph in FIG. 2. Whereas the primary current 26 starting with the start signal 24 flows in the primary winding 6 for a predefined period T, until the semiconductor switch 8 is opened, the current 27 in the primary winding 7 flows at most until it reaches a predefined upper threshold 34 or until the total secondary current 31 falls below the lower threshold 36. See the fourth graph in FIG. 2. Once the total primary current 28 has reached the upper threshold 34 or the total secondary current 31 has fallen below the lower threshold 36, the semiconductor switch 9 is opened so that the flow of current through the primary winding 7 changes abruptly and induces a high voltage in the secondary winding 5. The secondary current 29 flowing in the secondary winding 4 once the primary current 26 has been interrupted is illustrated in the fifth graph in FIG. 2. The secondary current 30, which flows in the secondary winding 5 once the primary current 27 has been interrupted, is illustrated in the sixth graph in FIG. 2. It can be seen that the secondary currents 29 and 30 flowing through the two secondary windings 4 and 5 are superimposed in the electrical circuit of the spark plug and overlap such that a flow of current 31 without interruption is provided, as is illustrated in the last graph in FIG. 2. This is a prerequisite for a discharge burning between the electrodes 1*a* and 1*b* of the spark plug and lasting as long as the total secondary current 31 flows without interruption. A further prerequisite for an uninterrupted discharge between the electrodes 1*a* and 1*b* is that the total secondary flow of current 31 does not fall below a lower threshold 36. The lower threshold 36 is established such that the discharge between the electrodes 1*a* and 1*b* of the spark plug continues to burn as long as the amperage does not fall below the lower threshold 36. Once the lower threshold 36 has been reached, the second ignition coil 43 is discharged by closing the semiconductor switch 9. Should the primary current 27 charging the second ignition coil 43 reach the upper threshold 34 beforehand, the discharge of the second ignition coil 43 will then already have been triggered.

If the upper threshold 34 of the total primary current 28 is only reached once the period T has elapsed, a control signal is conveyed from the control device 15 to the semiconductor switch 9 and opens said switch, whereupon a high voltage is induced in the secondary winding 5 and allows the total secondary current 31 to rise above a predefined upper threshold 35. See the bottom graph in FIG. 2. The total secondary current 31 then falls approximately linearly and reaches the upper threshold 35 from above, whereupon the control device 15 closes the semiconductor switch 8. As a result, the secondary current 29 through the secondary winding 4 falls abruptly to zero and the primary winding 6 is instead charged, this being indicated by the rising primary current 26. See the second primary current pulse in the second graph in FIG. 2. The rise in the primary current 26 now does not start at zero, but at a base value, because the semiconductor switch was closed before the discharge process at the ignition coil 31 had terminated. Whilst the primary winding 6 is charged for a second time, there is no charging process at the primary winding 7. The total primary current 28 is now the current flowing through the primary winding 6. As soon as this reaches its upper threshold 34, the semiconductor switch 8 is opened again, whereby a secondary current 29 is again produced in the secondary winding 4. See graph 5 in FIG. 2, which leads to a renewed sharp rise in the total secondary current 31 until above the upper threshold 35. See the last graph in FIG. 2. When the strength of the total secondary current 31 then reaches the upper threshold 35 from above, the semiconductor switch 9 is closed, resulting in the fact that the partly discharged primary winding 7 is then charged again, until the strength of the primary current 27 reaches the upper threshold 34 and the semiconductor switch 9 is opened again, which leads as a result of induction to a secondary current 30 in the secondary winding 5 and therefore to a further sharp rise in the strength of the total secondary current 31 until above the upper threshold 35. This interaction continues: each time the strength of the total secondary current 31 reaches the upper threshold 35 from above, the semiconductor switch 8 is closed or the semiconductor switch 9 is closed alternately, and thereafter said respective semiconductor switch is opened again when the strength of the total primary current 28 reaches its upper threshold 34.

If, for any reason, the strength of the total secondary current 31 should reach the lower threshold 36 before the strength of the total primary current 28 has reached the upper threshold 34, the previously closed semiconductor switch is opened in any case and the spark plug is thus supplied with a further current impulse so that the discharge burning between the electrodes 1*a* and 1*b* does not extinguish.

The interaction is continued until the discharge burning between the electrodes 1*a* and 1*b* has reached a predefined period, the ignition period Z. Once this is the case, both semiconductor switches 8 and 9 are held open by the control device 15 so that the two ignition coils 42 and 43 can discharge completely and the discharge between the two spark plug electrodes 1*a* and 1*b* extinguishes.

The described course of the method is performed once in each cycle of the internal combustion engine once it has been started by a start signal 24, which is normally supplied by an engine control unit and determines the ignition point for the spark plug 1.

Figure 3:
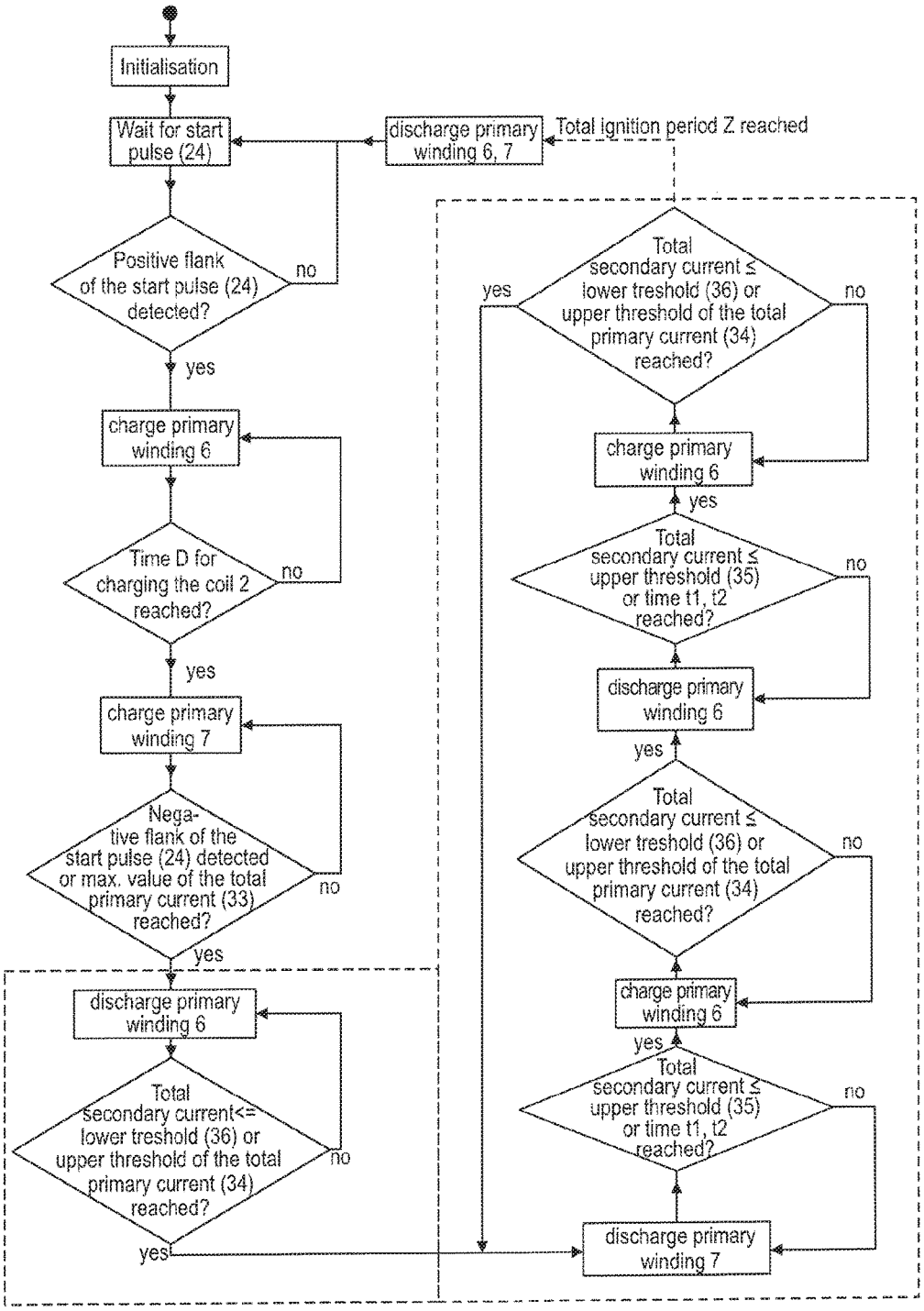
FIG. 3 shows a flow diagram of the method steps performed in the circuit arrangement according to FIG. 1.

FIG. 3 shows a flow diagram of the method described on the basis of FIG. 2. It starts with an initialisation, for example by turning the ignition key in the vehicle to switch on the ignition. The control device 15 then waits for a start signal 24. If the positive flank of the start signal 24 has been recognised, the primary winding 6 is charged. The control device 15 then waits for the time delay D to pass. Once the time D has elapsed, the control device 15 prompts the closure of the semiconductor switch 9. The control device then waits for the predefined period T to pass, the end of said period T being predefined in the example of FIG. 2 by the falling flank of the start signal 24. Once the falling (negative) flank of the start signal 24 has been recognised, the primary winding 6 is discharged until the strength of the total primary current 28 has reached its upper threshold 34, but at the latest until the strength of the total secondary current 31 has reached its lower threshold 36. In either case the control device 15 opens the semiconductor switch 9 so that the primary winding 7 or the ignition coil 43, respectively, can partially discharge. The discharge process is monitored on the basis of the total secondary current 31, and, as soon as the strength thereof falls below the upper threshold 35, the semiconductor switch 8 is closed and the primary winding 6 is charged until the strength of the total primary current 28 reaches its upper threshold 34, but at most until the strength of the total secondary current 31 reaches its lower threshold 36. The semiconductor switch 8 is then opened again and then the primary winding 6 or the ignition coil 31, respectively, is partially discharged until the total secondary current 31 reaches its upper threshold 35 from above. The semiconductor switch 9 is then closed again so as to charge the primary winding 7 until the strength of the total primary current 28 again reaches its upper threshold 34, at the latest until the strength of the total secondary current 31 reaches its lower threshold 36 from above.

The sequence of steps summarised in the box to the right in FIG. 3 is repeated until the desired ignition period Z is reached, that is to say the period for which the discharge burns between the two spark plug electrodes 1*a* and 1*b*. Once the end of this ignition period Z has been reached, the control device 15 holds the two semiconductor switches 8 and 9 open, until a further start signal 24 is conveyed for example by an engine control unit. The method according to this disclosure is then run through again. As illustrated in FIG. 2, the start signal 24 is preferably a TTL pulse, but could also be a message for example, which contains information concerning the charging onset, the discharging onset and the charging period of the respective ignition coil.

The method described with reference to FIGS. 2 and 3 can be modified in that charging the primary winding 6 of the first ignition coil 42 and charging the primary winding 7 of the second ignition coil 43 are not started when the strength of the total secondary current 31 falls below an upper threshold, but are started when a given time interval t1 ends, which time interval t1 is started whenever the strength of the total secondary current 31 falls to a lower threshold 36 or whenever the strength of the total primary current 28 raises to an upper threshold 34, see FIG. 2. In this modification the criterion "total secondary current≤upper threshold (35)?" is replaced in the flow diagram of FIG. 3 by the criterion "time t1 reached?", as depicted in FIG. 3.

Figure 4:
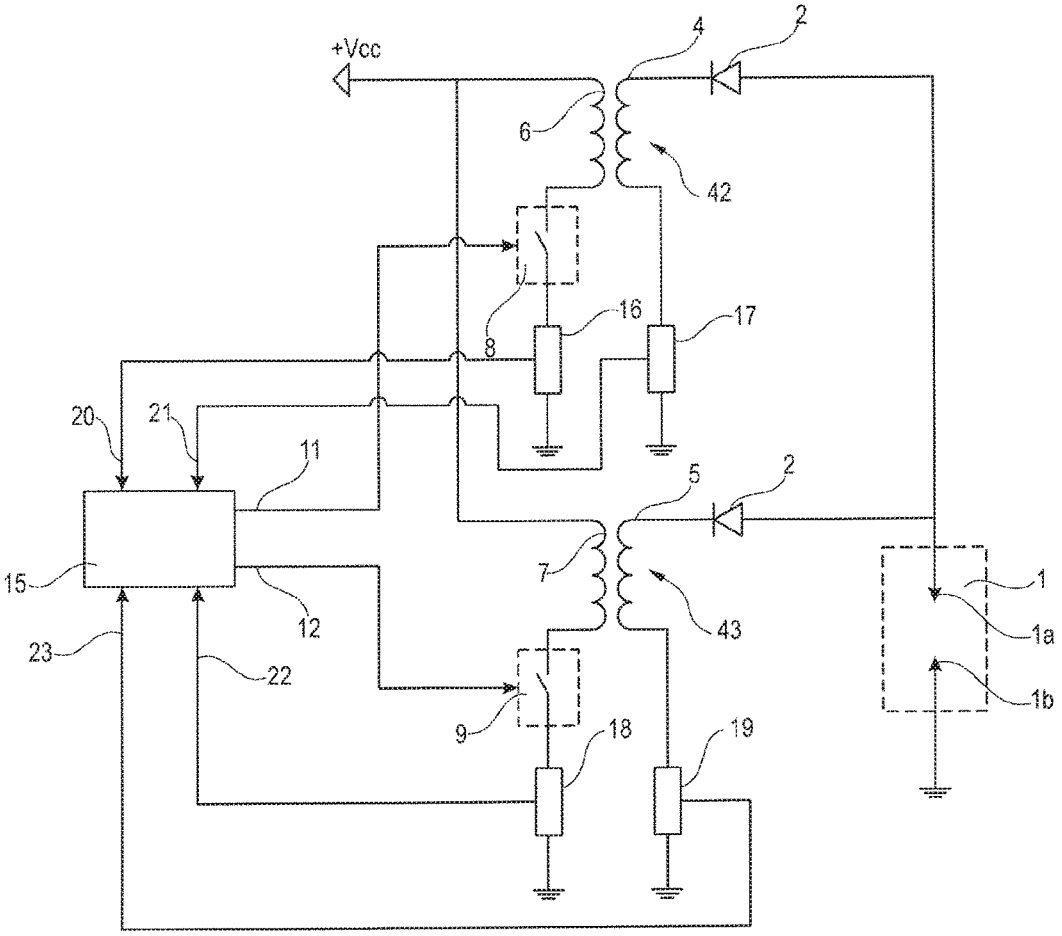
FIG. 4 shows a second exemplary embodiment of a circuit arrangement for carrying out the method according to this disclosure.
Figure 5:
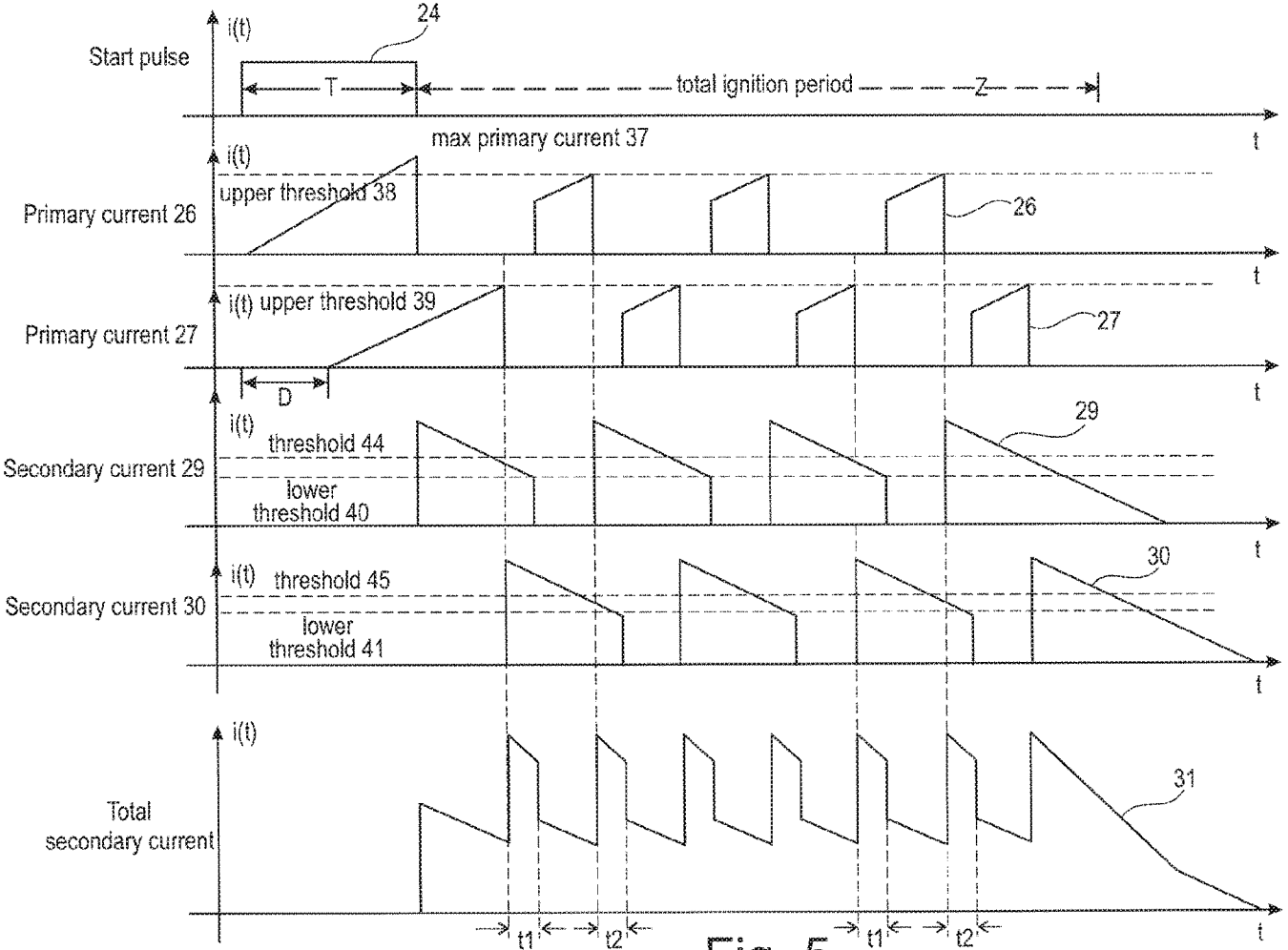
FIG. 5 shows a set of graphs, in which current profiles occurring in the circuit arrangement according to FIG. 4 are illustrated according to time.

Whereas, in the exemplary embodiment according to FIG. 1, the two ignition coils 42 and 43 are assigned a common measuring device 10 for measuring the total primary current 28 and a common measuring device 3 for measuring the total secondary current 31, in the exemplary embodiment according to FIG. 4 each of the two ignition coils 42 and 43 is assigned its own measuring device 16 and 18 respectively for measuring its primary current 26 and 27 respectively, and is assigned its own measuring device 17 and 19 respectively for measuring its secondary current 29 and 30 respectively. All four measuring devices 16 to 19 are connected to the control device 15 via an individually dedicated line 20, 21, 22 and 23 for the current measuring signals. Since, in this case, four current measurement values are obtained, these are compared separately to threshold values, as is illustrated in FIG. 5, namely the primary current 26 through the primary winding 6 is compared with an upper threshold 38 and the primary current 27 through the primary winding 7 is compared with an upper threshold 39. The two thresholds 38 and 39 are expediently selected so as to be identical. The secondary current 29 through the secondary winding 4 is compared with a lower threshold 40, which replaces the upper threshold 35 of the total secondary current 31 in FIG. 2. The secondary current 30 through the secondary winding 5 is compared with a lower threshold 41, which likewise replaces the upper threshold 35 in FIG. 2.

The modified method leads to the same result as the method in the first exemplary embodiment, which can be seen in the bottom graph in FIG. 5, which illustrates the profile of the total secondary current 31. This illustration in FIG. 5 coincides with the bottom graph in FIG. 2.

The method performed in the circuit arrangement according to FIG. 4 will be explained hereinafter on the basis of the flow diagram illustrated in FIG. 6.

Figure 6:
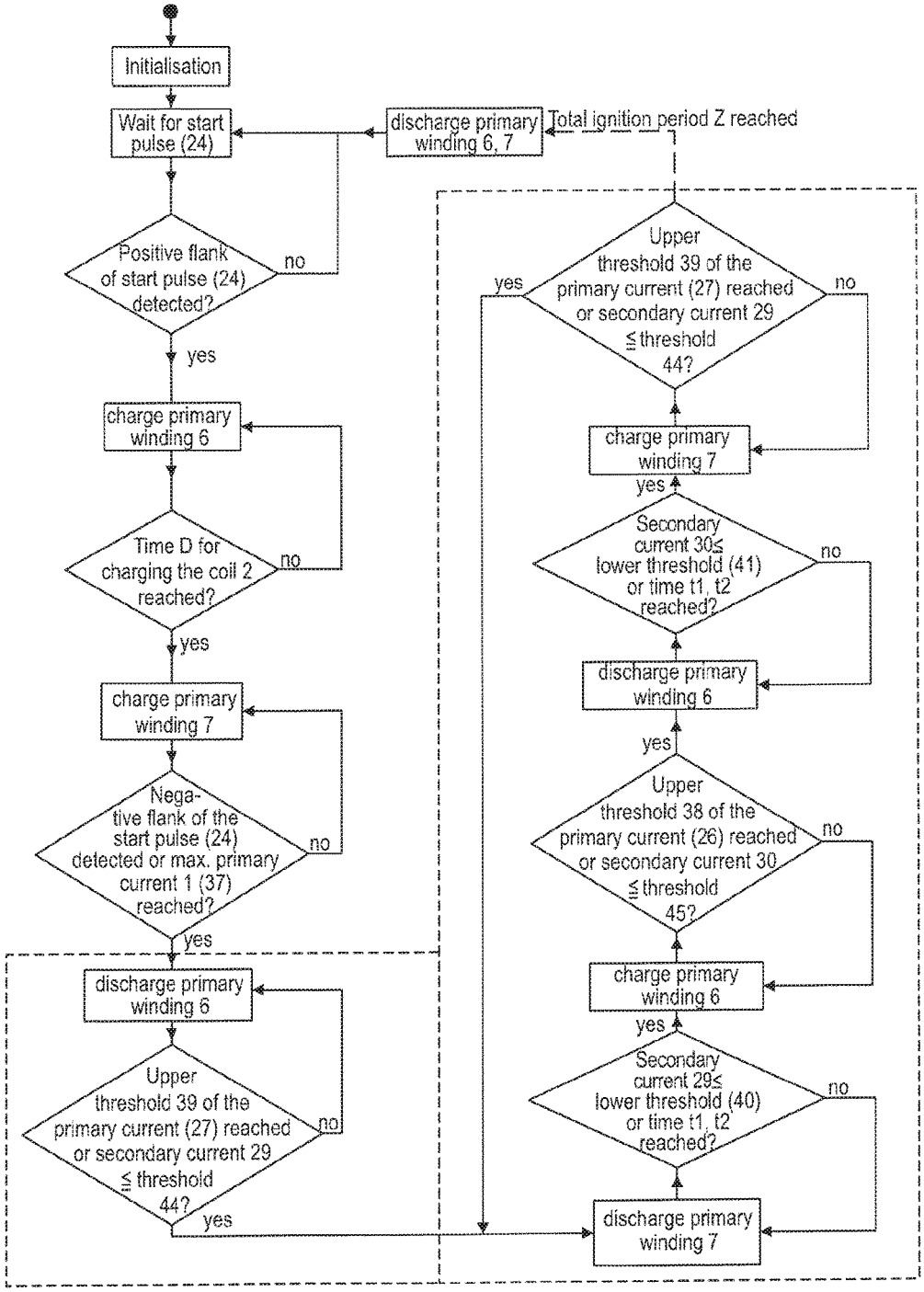
FIG. 6 shows a flow diagram of the method steps performed in the circuit arrangement according to FIG. 4.

If FIGS. 3 and 6 are compared, it can be seen that the steps in the left-hand column in FIG. 6 practically coincide with the steps in the left-hand column in FIG. 3. The only difference lies in the fact that there is no need to observe a lower threshold 36 of the total secondary current 31 when the primary windings 6 and 7 or the respective ignition coils 42 and 43 are discharged. The lower threshold 36 of the total secondary current is preferably used to ensure a total secondary current 31 without interruption. In the embodiment illustrated in FIG. 4, an additional threshold for the two individual secondary currents 29 and 30 can again be determined, which expediently lies above the lower thresholds 40 and 41 of the secondary currents 29 and 30, namely an upper threshold 44 for the secondary current 29 and an upper threshold 45 for the secondary current 30. Instead of monitoring the upper threshold 34 of the strength of the total primary current 28 in FIG. 3, in FIG. 6 the upper threshold 39 for the strength for the primary current 27 flowing through the primary winding 7 and/or the upper threshold 44 for the secondary current 29 flowing through the secondary winding 4 are monitored. As soon as the threshold 39 and/or the threshold 44 is reached or passed from above, the primary winding 7 or the ignition coil 43, respectively, is discharged partially by opening the semiconductor switch 8. In the meantime, the strength of the secondary current 29 through the secondary winding 4 is monitored in terms of whether it has reached its lower threshold 40. If this is the case, the semiconductor switch 8 is closed and the discharge of the ignition coil 42 is thus terminated and renewed charging thereof is initiated. Once the strength of the primary current 26 flowing through the primary winding 6 rises to its upper threshold 38 and/or the strength of the secondary current 30 flowing through the secondary winding 5 falls below its upper threshold 45, the ignition coil 42, and with it the primary winding 6, is partially discharged by opening the semiconductor switch 8. In the meantime, the secondary current 30 flowing through the secondary winding 5 is monitored in terms of whether its strength reaches the lower threshold 41. If this is the case, the semiconductor switch 9 is closed again, the discharge of the ignition coil 43 is thus terminated and renewed charging thereof is instead initiated. If the strength of the primary current 27 flowing through the primary winding 7 of the second ignition coil 43 has risen to its upper threshold 39 and/or the strength of the secondary current 29 flowing through the secondary coil 4 has fallen below its upper threshold 44, the semiconductor switch 9 is opened again and the partial discharge of the second ignition coil 43 is initiated. This interaction of the steps illustrated in the right-hand column in FIG. 6 is continued until the discharge burning between the electrodes 1*a* and 1*b* of the spark plug 1 has reached the end of the desired ignition period Z. Once this is the case, the control device 7 holds both semiconductor switches 8 and 9 open, such that both ignition coils 42 and 43 can discharge. The control device 15 then waits for a next start signal 24 so as to restart the method.

The thresholds 38 and 45 as well as the thresholds 39 and 44 can be used alternatively or jointly. If they are jointly used, then the threshold which is reached first causes the opening of the semiconductor switch 8 or the semiconductor switch 9, respectively. To use the thresholds 38 and 45 as well as the thresholds 39 and 44 gives a greater safety to the method.

The method described with reference to FIGS. 5 and 6 can be modified in that charging the primary winding 6 of the first ignition coil 42 and the charging of the primary winding 7 of the second ignition coil 34 are not started when the strength of the secondary current 29 or 30 flowing through the first ignition coil 42 or through the second ignition coil 34, respectively falls below a threshold 40 or threshold 41, respectively; instead of that charging the primary winding 6 of the first ignition coil 42 is started whenever a given time interval t1 ends, which is started whenever the strength of the secondary current 29 flowing through the first ignition coil 42 passes from above a lower threshold 44 or whenever the primary current 27 flowing through the second ignition coil 43 rises to an upper threshold 39. Correspondingly charging the primary winding 7 of the second ignition coil 43 is started whenever the strength of the secondary current 30 flowing through the second ignition coil 43 passes a lower threshold 45 from above or whenever the primary current 26 flowing through the first ignition coil 42 rises to an upper threshold 38. See FIG. 5. In this case in the flow diagram of FIG. 6 the criteria "secondary current 29≤lower threshold (40)?" and "secondary current 30≤lower threshold (41)?" are replaced by the criterion "time t1 reached?," as is illustrated in FIG. 6.

Figure 7:
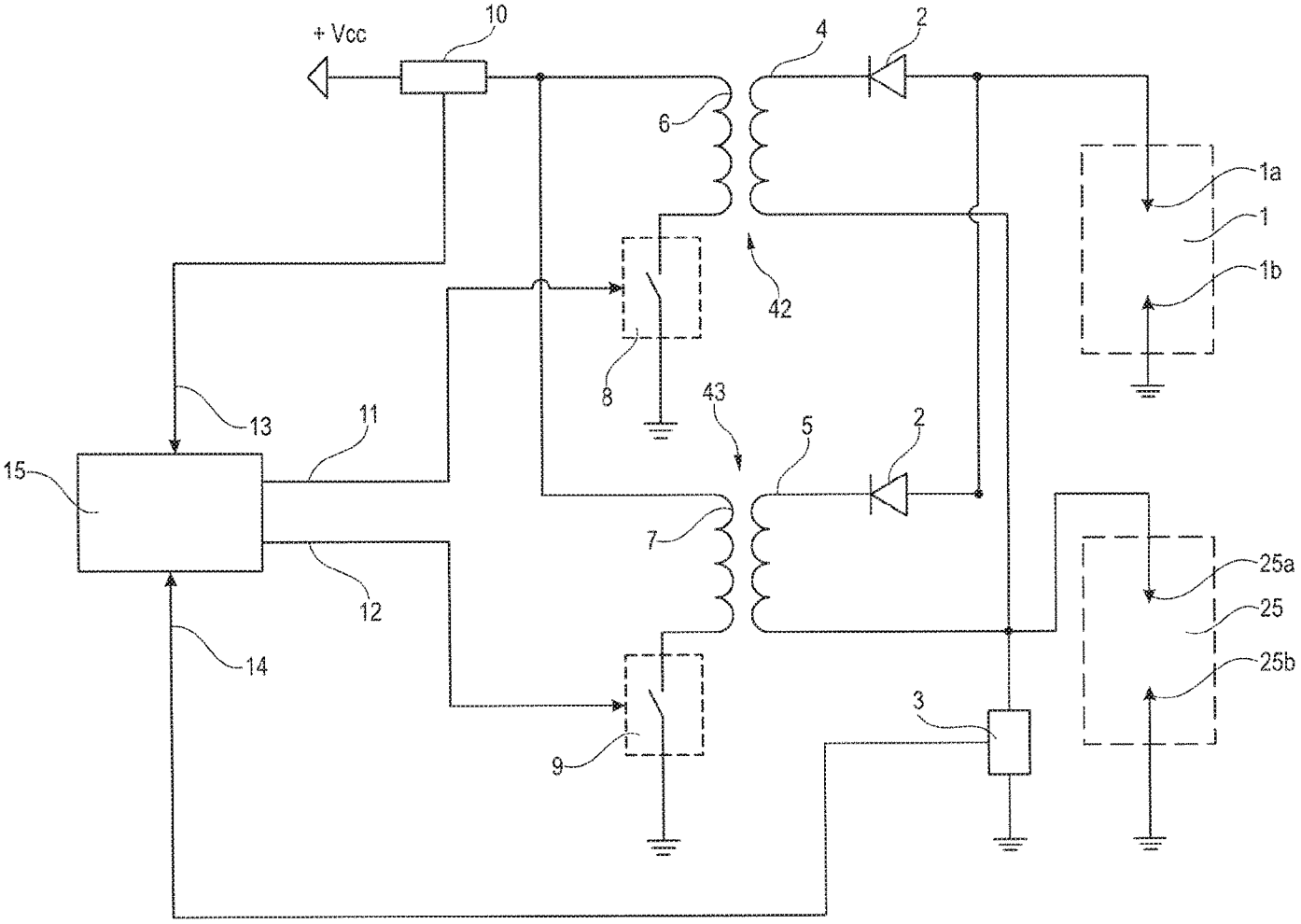
FIG. 7 shows a third exemplary embodiment of a circuit arrangement for carrying out the method according to this disclosure.

The exemplary embodiment illustrated in FIG. 7 differs from the exemplary embodiment illustrated in FIG. 1 in that the circuit arrangement not only actuates and ignites one spark plug, but two spark plugs 1 and 25. For this purpose, the two spark plugs 1 and 25 are connected in parallel.

With the circuit arrangement illustrated in FIG. 7 the method is carried out as follows:

The primary windings 6 and 7 with closed switches 8 and 9 are first charged with direct current from the direct current source Vcc. The diodes 2 are switched so that the secondary windings 4 and 5 are blocked as the primary windings 6 and 7 are charged. If the switch 8 is then opened, a very high voltage is produced in the secondary winding 4 due to the abrupt change of current in the primary winding 6 and results in a secondary direct current that flows in the secondary circuit of the ignition coil 42 in the forward direction of the diode 2.

FIG. 7 shows that not only is the spark plug 1 arranged in the secondary circuit of the ignition coil 42, but also the spark plug 25, which is connected in series to the spark plug 1. As soon as the high voltage in the secondary circuit generated by the discharge of the ignition coil 42 exceeds the dielectric strength of the gas mixture between the spark plug electrodes 1*a* and 1*b* as well as between the spark plug electrodes 25*a* and 25*b*, a discharge takes place therebetween. The two ignition coils 42 and 43 are controlled such that they operate in push-pull mode, so that a spark does not just flash over temporarily between the electrodes 1*a* and 1*b* and between the electrodes 25*a* and 25*b*: before the discharge, caused by opening the switch 11, between the spark plug electrodes 1*a* and 1*b* and 25*a* and 25*b* extinguishes, the switch 9 is opened and the switch 8 is closed, so that the spark plugs 1 and 25 are then supplied with further energy from the ignition coil 43, whereas the ignition coil 42 is simultaneously charged again. This interaction is continued until the discharge between the electrodes 1*a* and 1*b* of the spark plug 1 and between the electrodes 25*a* and 25*b* of the spark plug 25 has reached the end of a predefined period, and is then terminated by opening the two switches 8 and 9.

Since the two cylinders of the spark-ignition engine in which the sparks plugs 1 and 25 are located are selected such that, when one of the cylinders is in the compression stroke the other cylinder is in the exhaust stroke, only one discharge process of the two discharge processes simultaneously taking place at the two spark plugs 1 and 25 is then used to ignite a compressed fuel/air mixture.

Whilst a spark discharge takes place in the cylinder with the spark plug 1 in the compression stroke and leads to ignition of the fuel/air mixture, the other cylinder with the spark plug 25 is in its exhaust stroke; the exhaust gas provided during the exhaust stroke in the cylinder with the spark plug 25 is subject to a much lower pressure than the fuel/air mixture in the compression stroke. Since the ignition voltage is pressure-dependent, a much lower ignition voltage falls at the spark plug at which a discharge takes place in the exhaust stroke than at the spark plug in the cylinder currently in its compression stroke. As a result, much less energy is consumed for the ignition sparks igniting in the exhaust gas than for the ignition sparks produced in the compressed, as yet unburned fuel/air mixture. The majority of the ignition energy supplied by the two ignition coils 42 and 43 of a cylinder pair is therefore available for the ignition of the fuel/air mixture that is as yet unburned, this being advantageous.

Although in the ignition system according to FIG. 7 an ignition spark occurs between the electrodes of the spark plugs twice as often as in the exemplary embodiment in FIG. 1, this does not have a disadvantageous effect on the service life of the spark plugs, or only affects the service life to an insignificant extent, because the energy of the ignition spark responsible for the burn-up of the ignition electrodes is much smaller during each second discharge, namely with the sparks occurring in the exhaust stroke, than with an ignition spark occurring in the compression stroke.

Due to the alternating discharge of the two ignition coils 42 and 43, a continuous ignition spark is generated at the spark plugs 1 and 25 in the method explained on the basis of FIG. 1 and lasts until the actuation of the ignition coils 42 and 43 is terminated, that is to say until the alternating connection of their primary windings 6 and 7 to the direct current source Vcc is terminated. The switches 8 and 9 are controlled such that there are no interruptions in the superimposition of the sequence of the secondary current pulses generated in the secondary windings 4 and 5. This means that the secondary current pulses occurring alternately in one secondary winding 4 and in the other secondary winding 5 follow one another or overlap one another without interruption. The method can also be modified however such that there are interruptions in the superimposition of the secondary current pulses generated in the secondary windings 4 and 5. Instead of an extended ignition pulse, a sequence of ignition pulses that together ensure increased ignition energy and therefore improved ignition are obtained in each engine cycle in each cylinder.

Figure 8:
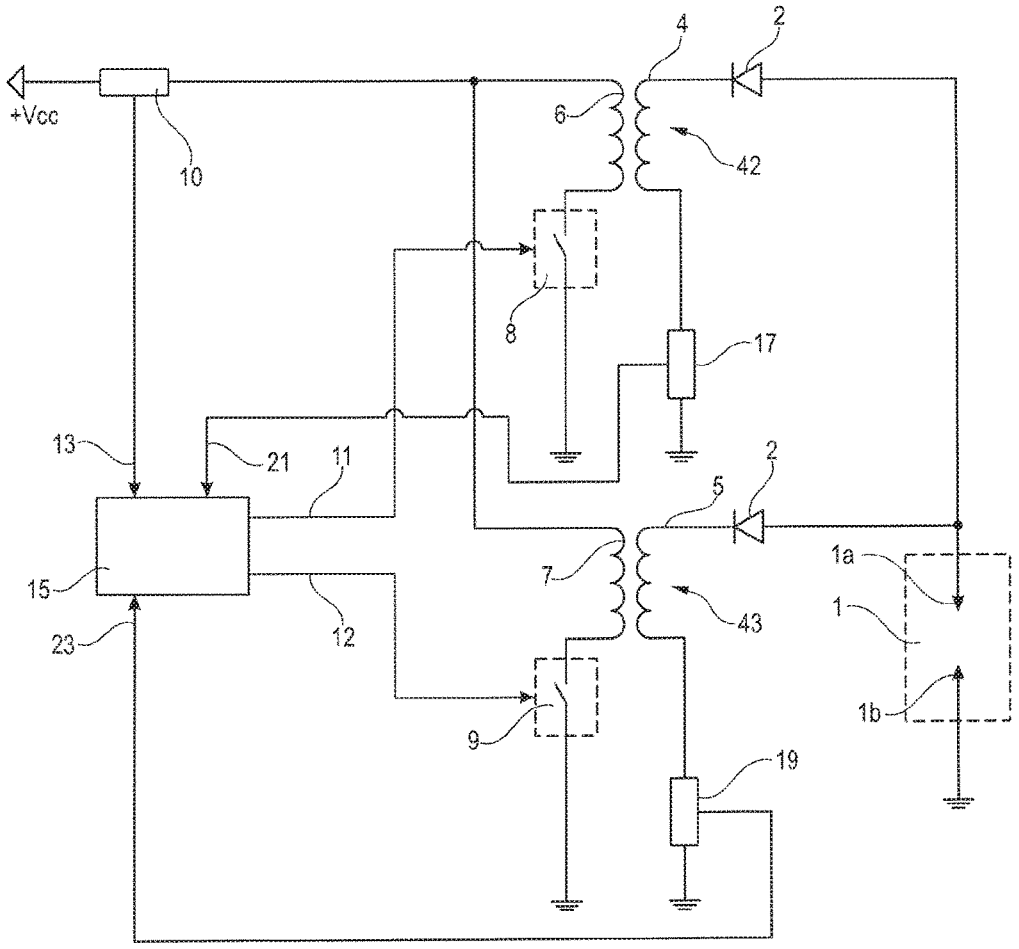
FIG. 8 shows a fourth exemplary embodiment of a circuit arrangement for carrying out the method according to this disclosure.

The circuit arrangement shown in FIG. 8 is a combination of the circuit arrangements shown in FIGS. 1 and 4. FIG. 8 differs from FIG. 1 in that the secondary current flowing through the first ignition coil 42 and the secondary current flowing through the second ignition coil 43 are measured individually using separate measurement devices 17 and 19, as illustrated in FIG. 4, and are monitored for reaching thresholds. With the circuit arrangement shown in FIG. 8 it is possible to carry out the method according to claim 3 which is obtained by combining the methods according to claim 1 and claim 2.

Figure 9:
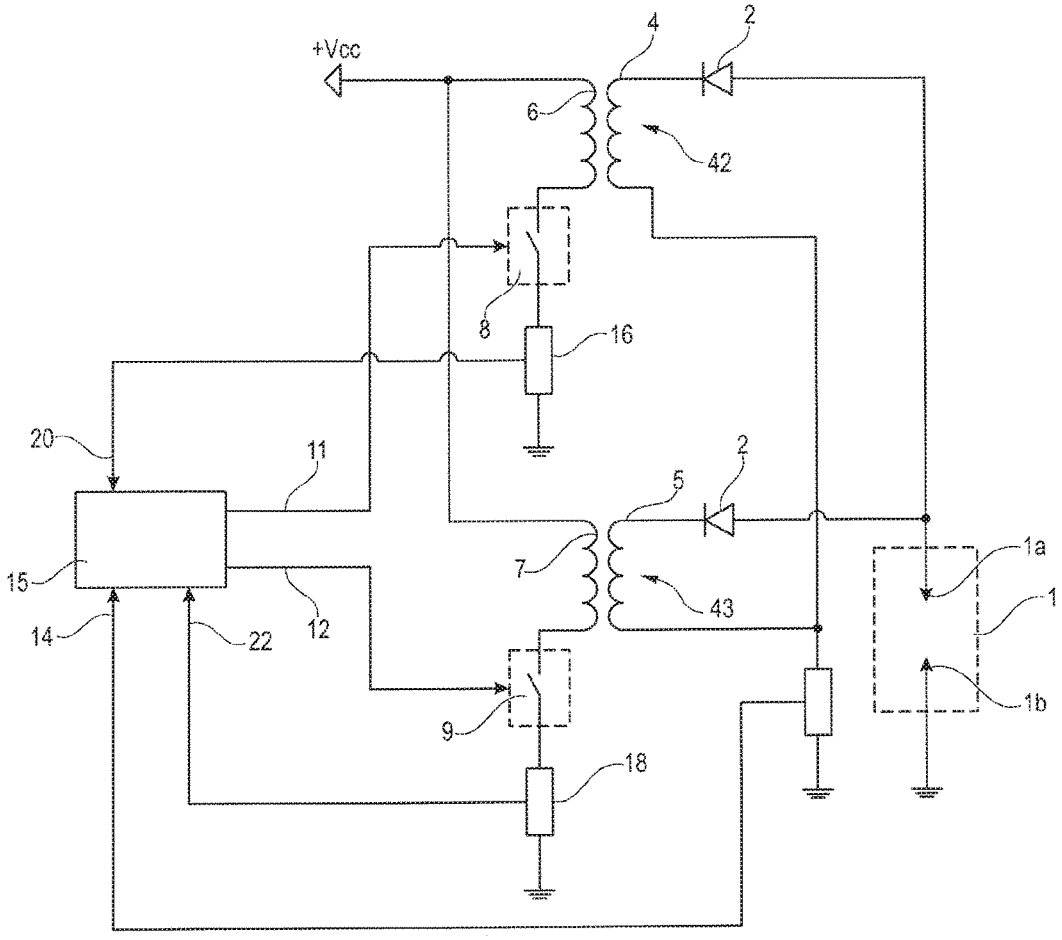
FIG. 9 shows a fifth exemplary embodiment of a circuit arrangement for carrying out the method according to this disclosure.

The circuit arrangement shown in FIG. 9 differs from the circuit arrangement shown in FIG. 1 in that the two primary currents flowing through the ignition coil 42 and through the ignition coil 43 are individually measured using separate measurement devices 16 and 18, as illustrated in the circuit arrangement of FIG. 4, and are monitored for reaching thresholds. By using the circuit arrangement of FIG. 4 there can be carried out the method according to claim 4 which can likewise be obtained by combining the methods according to claim 1 and claim 2.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

List of reference signs

| | |
|---|---|
| 1 | spark plug, spark gap |
| 1a | central electrode |
| 1b | ground electrode |
| 2 | diode |
| 3 | device for measuring the total secondary current |
| 4 | secondary winding |
| 5 | secondary winding |
| 6 | primary winding |
| 7 | primary winding |
| 8 | semiconductor switch for primary winding 6 |
| 9 | semiconductor switch for primary winding 7 |
| 10 | device for measuring the total primary current |
| 11 | control line for semiconductor switch 8 |
| 12 | control line for semiconductor switch 9 |
| 13 | measuring signal of the total primary current |
| 14 | measuring signal of the total secondary current |
| 15 | control device or control unit |
| 16 | device for measurement of the primary current in the primary winding 6 |
| 17 | device for measurement of the secondary current in the secondary winding 4 |
| 18 | device for measurement of the primary current in the primary winding 7 |
| 19 | device for measurement of the secondary current in the secondary winding 5 |
| 20 | line for the measurement signal of the primary current according to numeral 16 |
| 21 | line for the measurement signal of the secondary current according to numeral 17 |
| 22 | line for the measurement signal of the primary current according to numeral 18 |
| 23 | line for the measuring signal of the secondary current according to numeral 19 |
| 24 | start signal |
| 25 | spark plug, spark gap |
| 25a | central electrode of the spark plug 25 |
| 25b | ground electrode of the spark plug 25 |
| 26 | current through the primary winding 6 |
| 27 | current through the primary winding 7 |
| 28 | total primary current (primary current 28 + primary current 27) |
| 29 | current through the secondary winding 4 |
| 30 | current through the secondary winding 5 |
| 31 | total secondary current (secondary current 29 + secondary current 30) |
| 33 | maximum value of the strength of the total primary current |
| 34 | upper threshold of the strength of the total primary current |
| 35 | upper threshold of the strength of the total secondary current |
| 36 | lower threshold of the strength of the total secondary current |
| 37 | maximum primary current in the primary winding 6 |
| 38 | upper threshold of the strength of the primary current in the primary winding 6 |
| 39 | upper threshold of the strength of the primary current in the primary winding 7 |
| 40 | lower threshold of the strength of the secondary current in the secondary winding 4 |
| 41 | lower threshold of the strength of the secondary current in the secondary winding 5 |
| 42 | first ignition coil |
| 43 | second ignition coil |
| 44 | upper threshold of the strength of the secondary current 29 in the secondary winding 4 |
| 45 | upper threshold of the strength of the secondary current 30 in the secondary winding 5 |
| D | delay |
| T | period |
| t1 | time interval |
| t2 | time interval |
| Vcc | direct current source |
| Z | ignition period |

What is claimed is:

1. A method for actuating a spark gap in an internal combustion engine in which the spark gap is assigned a first ignition coil and a second ignition coil, each of which has a primary winding and a secondary winding that are inductively coupled to one another, the method comprising the following steps:

(a) triggered by a start signal, charging the primary winding of the first ignition coil and with a delay D, for which 0≤D, charging the primary winding of the second ignition coil by supplying a direct current, wherein, whilst each primary winding is charged, the respective secondary winding is blocked;

(b) measuring a primary current supplied to each of the primary windings;

(c) after a period T, abruptly discharging the primary winding of the first ignition coil, and with the delay D abruptly discharging the primary winding of the second ignition coil, whereby secondary currents are induced in the respective secondary windings, which lead to an electrical discharge between two electrodes of the spark gap;

(d) measuring the secondary current flowing through each of the ignition coils;

(e) thereafter alternately starting a charging of the primary winding of the first ignition coil and a charging of the primary winding of the second ignition coil whenever the strength of the secondary current flowing through the first or second ignition coil falls below a threshold;

(f) abruptly discharging the primary winding of the first ignition coil whenever the strength of the primary current flowing through the primary winding of the first ignition coil rises to an upper threshold and/or whenever the secondary current flowing through the secondary winding of the second ignition coil falls below an upper threshold, and abruptly discharging the primary winding of the second ignition coil alternately with the primary winding of the first ignition coil whenever the strength of the primary current flowing through the primary winding of the second ignition coil rises to an upper threshold and/or whenever the secondary current flowing through the secondary winding of the first ignition coil falls below an upper threshold;

(g) repeating steps (e) and (f) until the duration of the discharge process between two electrodes of the spark gap reaches a predefined value Z; and (h) thereafter both primary windings remain separated from the supply of direct current until there occurs a further start signal and the above sequence of steps is restarted with step (a).

2. The method according to claim 1, wherein the secondary windings of each of the first and second coils are blocked by a diode arranged in an electrical circuit of each of the respective secondary windings, whilst their respective primary winding is charged.

3. The method according to claim 1, wherein D is selected to be D>0.

4. The method according to claim 1, wherein the delay D is selected such that the first charging process of the primary winding of the first ignition coil and the first charging process of the primary winding of the second ignition coil overlap in time.

5. The method according to claim 1, wherein the charging processes of the primary winding of the first and second ignition coil are interrupted before the charging processes reach saturation.

6. The method according to claim 5, wherein the charging processes are then interrupted at the latest when 95% of the saturation amperage is reached in the primary windings.

7. The method according to claim 5, wherein the charging processes are interrupted while the amperage in the primary windings is rising linearly.

8. The method according to claim 1, wherein D is selected to be 0.4 T<D<0.7 T.

9. The method according to claim 1, wherein D is selected to be 0.5 T<D<0.7 T.

10. The method according to claim 1, wherein the delay D is selected such that each discharging process or the associated secondary current in the second ignition coil, respectively, overlaps in time with the directly preceding discharging process or with the associated secondary current in the first ignition coil, respectively.

11. The method according to claim 1, wherein the upper threshold of the strength of the primary current and/or the lower threshold of the strength of the secondary current is changed after step (g) of a method run and before step (a) of the next method run.

12. The method according to claim 1, wherein within a method run from step (a) to step (g) the thresholds remain unchanged.

13. A method for actuating a spark gap in an internal combustion engine in which the spark gap is assigned a first ignition coil and a second ignition coil, each of which has a primary winding and a secondary winding that are inductively coupled to one another, the method comprising the following steps:

(a) triggered by a start signal, charging the primary winding of the first ignition coil and with a delay D, for which 0≤D, charging the primary winding of the second ignition coil by supplying a direct current, wherein, whilst each primary winding is charged, the respective secondary winding is blocked;

(b) measuring a primary current supplied to each of the primary windings;

(c) after a period T, abruptly discharging the primary winding of the first ignition coil, and with the delay D abruptly discharging the primary winding of the second ignition coil, whereby secondary currents are induced in the respective secondary windings, which lead to an electrical discharge between two electrodes of the spark gap;

(d) measuring the secondary current flowing through each of the ignition coils;

(e) thereafter starting a charging of the primary winding of the first ignition coil whenever a given time interval t1 ends, which time interval t1 is started whenever the strength of the secondary current flowing through the first ignition coil falls below a threshold or whenever the primary current flowing through the second ignition coil rises to an upper threshold, and starting a charging of the primary winding of the second ignition coil alternately with charging the primary winding of the first ignition coil whenever a given time interval t2 ends, which time interval t2 is started whenever the strength of the secondary current flowing through the first or second ignition coil falls below a threshold or whenever the primary current flowing through the first ignition coil rises to an upper threshold;

(f) abruptly discharging the primary winding of the first ignition coil whenever the strength of the primary current flowing through the primary winding of the first ignition coil rises to an upper threshold and/or whenever the secondary current flowing through the secondary winding of the second ignition coil falls below an upper threshold, and abruptly discharging the primary winding of the second ignition coil alternately to the primary winding of the first ignition coil whenever the strength of the primary current flowing through the primary winding of the second ignition coil rises to an upper threshold and/or whenever the secondary current flowing through the secondary winding of the first ignition coil falls below an upper threshold;

(g) repeating steps (e) and (f) until the duration of the discharge process between two electrodes of the spark gap reaches a predefined value Z; and (h) thereafter both primary windings remain separated from the supply of direct current until there occurs a further start signal and the above sequence of steps is restarted with step (a).

14. The method according to claim 13, wherein the time intervals t1 and t2 are selected to be zero or are selected to be sufficiently short such that the pulse-shaped secondary currents which flow through the second ignition coil follow without interruption the pulse-shaped secondary currents which flow through the first ignition coil, and vice versa, or that they superimpose each other.

15. The method according to claim 13, wherein the time intervals t1 and t2 are so selected that $0 \leq t1, t2 \leq 500$ μs.

16. The method according to claim 13, wherein the time intervals t1 and t2 are selected such that $0 \leq t1, t2 \leq 100$ μs.

17. The method according to claim 13, wherein the time intervals t1 and t2 are changed in accordance with settings from an engine control unit.

18. The method according to claim 17, wherein the time intervals t1 and t2 remain unchanged in a method run from step (a) to step (g).

* * * * *